United States Patent [19]

Fukute

[11] Patent Number: 4,775,779

[45] Date of Patent: Oct. 4, 1988

[54] SLIDE RULE FOR SELECTING MATERIAL FOR CONSTRUCTING BEARING

[75] Inventor: Osamu Fukute, Inuyama, Japan

[73] Assignee: Daido Metal Company Ltd., Nagoya, Japan

[21] Appl. No.: 23,396

[22] Filed: Mar. 9, 1987

[30] Foreign Application Priority Data

Mar. 20, 1986 [JP] Japan ..... 61-62034

[51] Int. Cl.[4] ..... G06C 27/00

[52] U.S. Cl. ..... 235/70 R; 235/70 A

[58] Field of Search ..... 235/69, 70 R, 70 A, 235/70 B

[56] References Cited

U.S. PATENT DOCUMENTS 3,135,465 6/1964 Squier et al. ..... 235/70 R 3,690,547 9/1972 Eadon-Allen ..... 235/70 R

*Primary Examiner*—B. R. Fuller

*Attorney, Agent, or Firm*—Browdy and Neimark

[57] ABSTRACT

A slide rule for selecting bearing materials has a base plate, a fixed cursor having first, second and third portions spaced apart from one another and fixedly attached to the base plate, a first sliding ruler slidably mounted between the first and second portions of the fixed cursor, an indicator cursor having an indicator cursor line and fixed to the first sliding ruler, a second sliding ruler slidably mounted between the second and third portions of the fixed cursor, and a fixed ruler mounted on the opposite side to the second sliding ruler with the third portion of the fixed cursor interposed therebetween. The fixed cursor has a fixed cursor line in the vicinity of its left end. The first sliding ruler has logarithmic graduations which indicate levels of bearing surface pressure. The second sliding ruler has logarithmic graduations which indicate sliding speeds, PV values and periods of lifetime of various bearing materials. The fixed ruler has graduations which indicate bearing temperatures and on which correction factors in respect of bearing temperatures and information on various bearing materials are indicated. The slide rule is manipulated on the basis of given values of bearing surface pressure and sliding speed to provide information on a PV value of a bearing, a lifetime of a bearing material, regreasing time, danger limits, attention limits, safety limits and so forth.

4 Claims, 9 Drawing Sheets

SLIDE RULE FOR SELECTING MATERIAL FOR CONSTRUCTING BEARING

BACKGROUND OF THE INVENTION

The present invention relates to a slide rule used to select an appropriate material for constructing a bearing.

Traditionally, bearing materials have been selected in consideration of the service condition of the bearing concerned by referring to individual catalogues specifying them.

There are, however, problems in the conventional process of selecting bearing materials as follows.

(A) It is not possible to study various aspects of the bearing materials available, so that it is not possible to ascertain the best material for forming a particular bearing.

(B) It is a laborious task to select a bearing material.

(C) A great deal of time is required of the manufacturers of bearing materials, etc. if they are to make their products known to the public.

(D) It is difficult for persons devoid of expertises or designers to select the most suitable material for a bearing.

SUMMARY OF THE INVENTION

It is an object of the present invention to provide a slide rule used for selecting bearing materials and which eliminates the above-described problems in the conventional process of selecting bearing materials.

To this end, the present invention provides a slide rule for selecting bearing materials, comprising a base plate, a fixed cursor having first, second and third portions spaced apart from one another and fixedly attached to the base plate, a first sliding ruler slidably mounted between the first and second portions of the fixed cursor, an indicator cursor having an indicator cursor line and fixed to the first sliding ruler, and a second sliding ruler slidably mounted between the second and third portions of the fixed cursor, the second portion of the fixed cursor having a fixed cursor line in the vicinity of its left end, the first sliding ruler having logarithmic graduations which indicate levels of bearing surface pressure, and the second sliding ruler having logarithmic graduations which indicate sliding speeds, PV values and periods of lifetime of various bearing materials.

In another aspect, the invention provides a slide rule for selecting bearing materials, comprising a base plate, a fixed cursor having first, second and third portions spaced apart from one another and fixedly attached to the base plate, a first sliding ruler slidably mounted between the first and second portions of the fixed cursor, an indicator cursor having an indicator cursor line and fixed to the first sliding ruler, a second sliding ruler slidably mounted between the second and third portions of the base plate, and a fixed ruler mounted on the opposite side to the second sliding ruler with the third portion of the fixed cursor interposed therebetween, the fixed cursor having a fixed cursor line in the vicinity of its left end, the first sliding ruler having logarithmic graduations which indicate levels of bearing surface pressure, the second sliding ruler having logarithmic graduations which indicate sliding speeds, PV values and periods of lifetime of various bearing materials, and the fixed ruler having graduations which indicate bearing temperatures and on which correction factors in respect of bearing temperatures and information on various bearing materials are indicated.

DESCRIPTION OF THE PREFERRED EMBODIMENT

Figure 1:
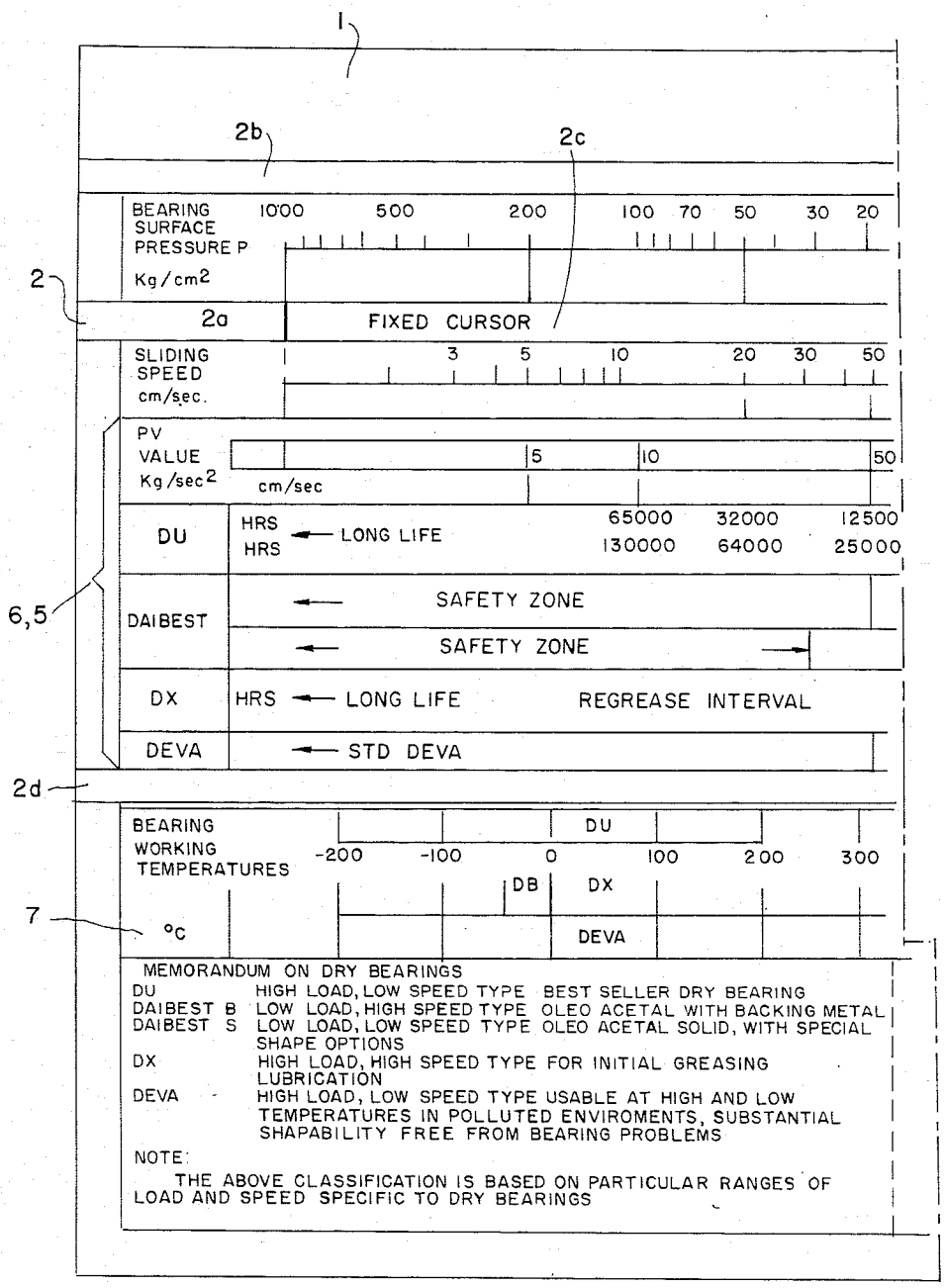
FIG. 1 is a plan view of a slide rule for selecting bearing materials which represents an embodiment of the present invention.
Figure 1A:
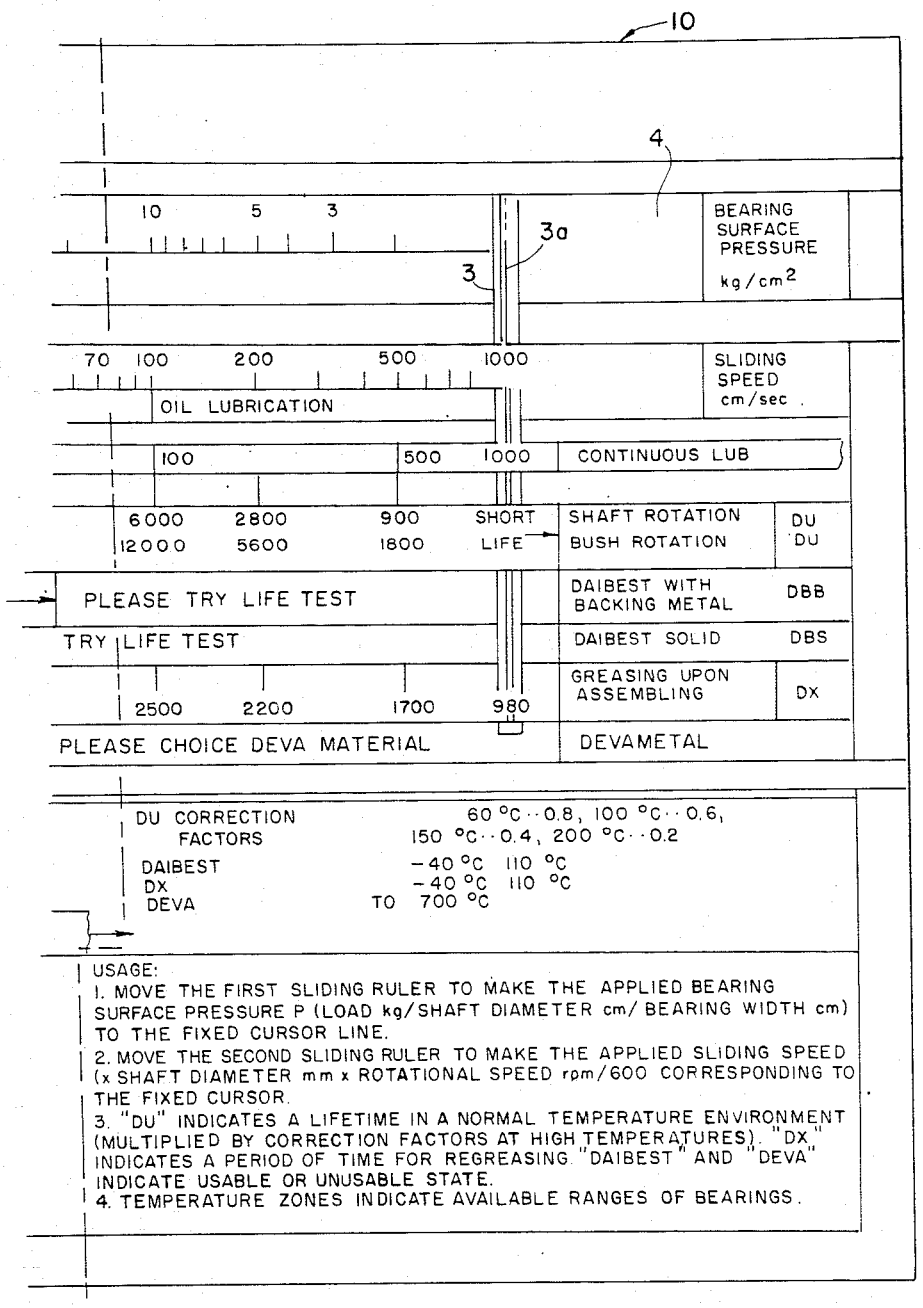

FIG. 1 shows a slide rule 10 for selecting bearing materials which is an embodiment of the present invention. This slide rule is mainly formed of a transparent synthetic resin and comprises a base plate 1, a fixed cursor 2, a first sliding ruler 4, an indicator cursor 3 fixed to the first sliding ruler and a second sliding ruler 5. The fixed cursor 2 includes first, second and third portions 2*b*, 2*c* and 2*d*, respectively, fixed to the base plate. A fixed cursor line 2*a* is scribed near the left end of the second portion 2*c*. The first sliding ruler 4 is slidably mounted between the first and second portions 2*b* and 2*c* of the fixed cursor, and the second sliding ruler 5 is slidably mounted between the second and third portions 2*c* and 2*d* of the fixed cursor.

The indicator cursor 3 is formed of a transparent synthetic resin and has an indicator cursor line 3*a* scribed thereon. A groove may be formed in the indicator cursor 3 and coated with red paint to form this indicator cursor line. The first sliding ruler 4 has logarithmic graduations which indicate the levels of bearing surface pressure P (kg/cm$^2$). The second sliding ruler 5 has scales including logarithmic graduations or characters for indicating sliding speeds (or peripheral speed) (cm/sec), PV values (kg/cm$^2$.cm/sec) and items 6 of various bearing materials. The materials given on the scale may include DU, Daibest, and DEVA. The lifetimes, the safety limits, the test limits, the regrease intervals of these materials are indicated by the graduations. A fixed ruler 7 is integrally formed on the base plate 1 such that the third portion 2*d* of the fixed cursor is interposed between this fixed ruler 7 and the second sliding ruler 5. The fixed ruler 7 indicates the ranges of bearing lubricating temperature applied to various bearing materials and correction factors corresponding to the degrees of bearing material temperature, or it has graduations indicating these ranges and factors. The fixed ruler 7 also has notes inscribed thereon with respect to various bearing materials and the usages of the same. The graduations on the fixed ruler 7 which indicate temperatures do not form a logarithmic scale. They are determined on the basis of the temperatures at which bearings are actually used. The correction factors are commonly applied to the above-mentioned bearing materials. The respective areas in which temperatures, notes and usage are inscribed are independent of the graduations of the cursor, the first and second sliding rules, and represent the correction factors for obtaining a correct lifetime.

A DU dry bearing is a high-performance PTFE bearing. It is made by sintering porous bronze onto a back metal (steel or bronze), and permeating a mixture of PTFE and Pb through the same and coating the mixture thereon; and these materials are thereafter baked. Daibest Solid (DBS) is made by meting, naturally cooling, solidifying and pulverizing a composition having a main component consisting of a synthetic resin such as polyacetal, additives consisting of a lubricating oil and fibers having an affinity for oil, and metallic soap and/or a solid-state lubricating agent added to it as desired, and thereafter forming the same into a desired shape. Daibest with back metal (DBB) is made by permeating the above composition of Daibest Solid into pores of a porous metal layer formed on the surface of a back metal and coating this layer with the same composition, thereafter baking the resulting product. A DX bearing is a polyacetal pre-lubricating bearing which is made by adding a wear-resisting agent to the polyacetal resin instead of the PTFE and Pb of the above-described dry bearing. A DEVA metal is a graphic high-temperature dry bearing which contains graphite of 4 to 14 weight percent (three times higher than this in volometric percent) and which is made by special sintering with bronze (Fe, Ni, etc.) used as a base. It is mainly formed as a solid, or may be formed with a back metal. The above-mentioned DU and DX are registered trade marks of Glacia Metal, U.K., Daibest is a registered trade mark of Daido Metal Kogyo K.K., and DEVA is a trade mark of Defenterwerke Gesellschaft mit Petshlenter Haftung, West Germany.

By employing the slide rule in accordance with the present invention, the PV value and the lifetime, etc. of a sliding bearing can be known from the bearing surface pressure (also called bearing load pressure or bearing load) and the sliding speed given as service conditions. The operating condition of the slide rule in which the first and second sliding rules are being used will be described below with reference to FIGS. 2 to 8. For the purpose of clarity, in the drawings, the characters and marks on the slide rule 10 are partially omitted and the slide rule is shown on a reduced scale.

Figure 2:
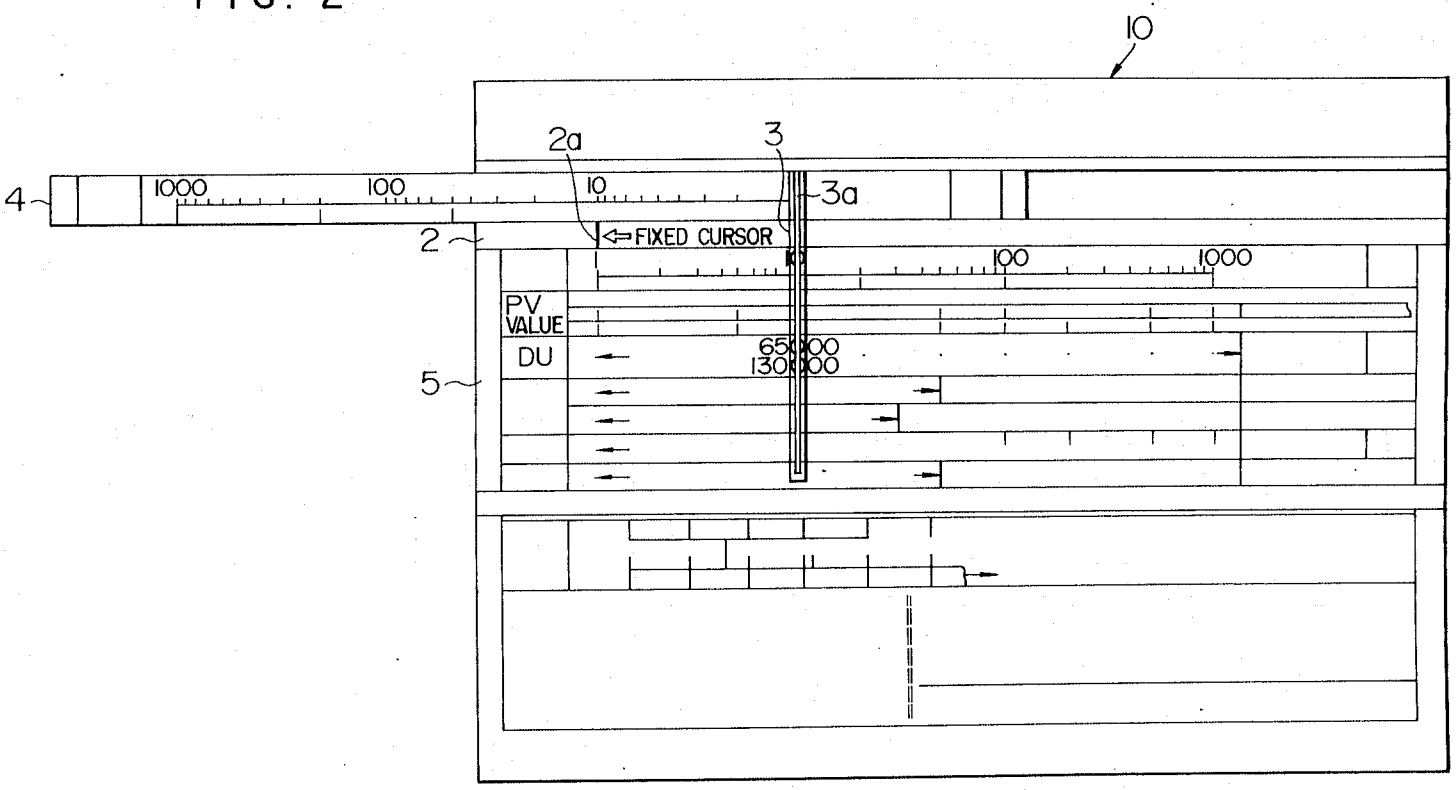
FIGS. 2 to 8 are plan views illustrating on a reduced scale the state in use of the slide rule shown in FIG. 1 (the characters and marks are partially omitted).

If the bearing surface pressure is 10 kg/cm$^2$ and the sliding speed is 1 cm/sec, the PV value and the lifetime can be found in the following manner. As shown in FIG. 2, the first sliding ruler 4 is slidingly moved to the left, a scale mark of this ruler corresponding to a value 10 is registered with the fixed cursor line 2*a* of the fixed cursor 2, and a scale mark of the logarithmic scale of the sliding speed formed on the second sliding ruler 5, which scale mark corresponds to a value 1, is registered with the fixed cursor line 2*a*. A PV value of 10 kg/cm$^2$.cm/sec and the lifetime of the bearing material are thereby found. If the material is a DU bearing, a lifetime of 65,000 hours is found in the case of the shaft rotation type, while a lifetime of 130,000 hours is found in the case of the bush rotation type. It is thus found that the lifetime of the bearing is within safety limits. If the material of the bearing is DX or DEVA, it is also found that the lifetime of the bearing is within safety limits. These values for the lifetime are for normal temperatures. They may be multiplied by correction factors to correspond to the working temperature of the bearing.

Figure 3:
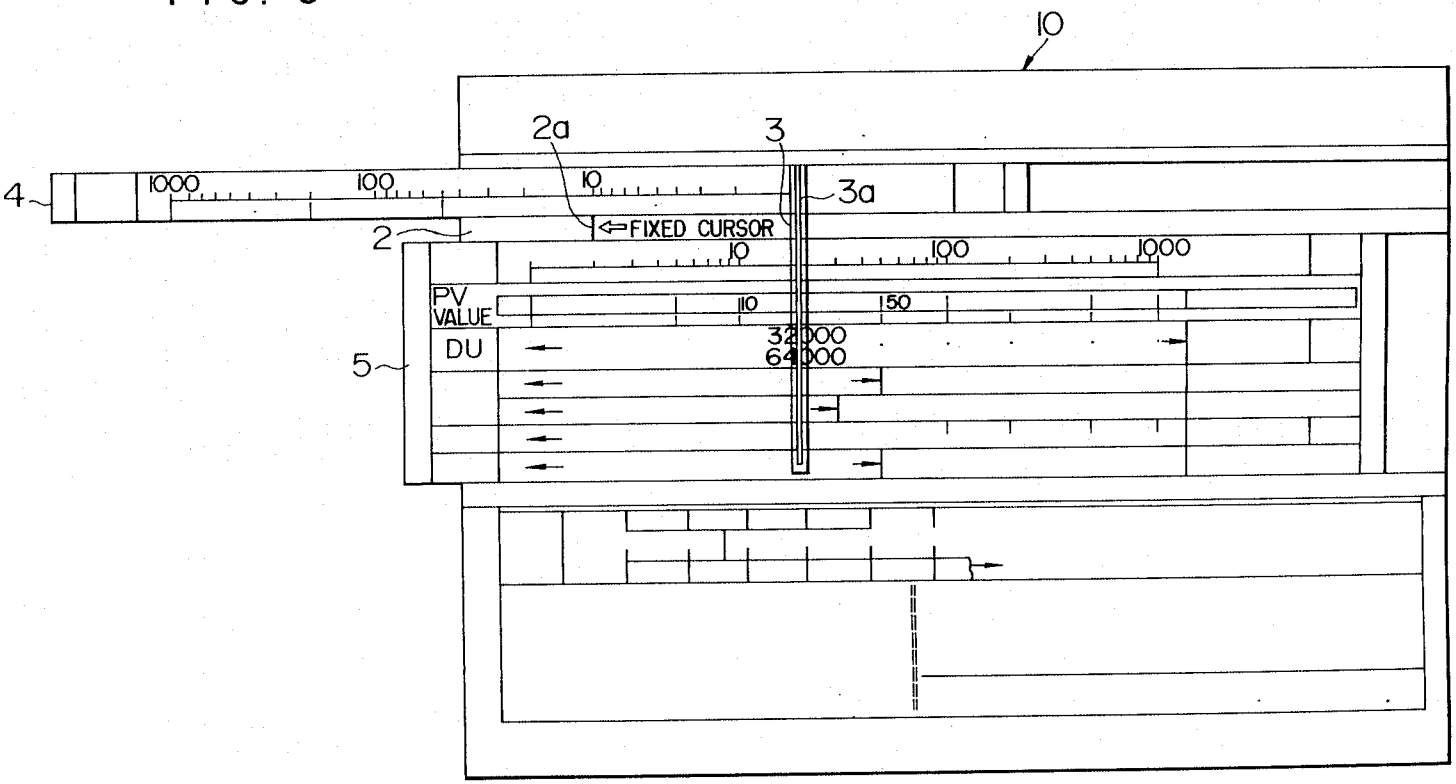

Referring now to FIG. 3, by operating the first and second sliding rulers as in the manner shown in FIG. 2, if the sliding speed is 2 cm/sec and the bearing surface pressure is 10 kg/cm$^2$, it is found that the PV value is 20 kg/cm$^2$.cm/sec and the lifetime is not more than one half of that found in the case shown in FIG. 1. In this case also, the bearing lifetime and the bearing working temperature of the bearing material are found to be within safety limits.

Figure 4:
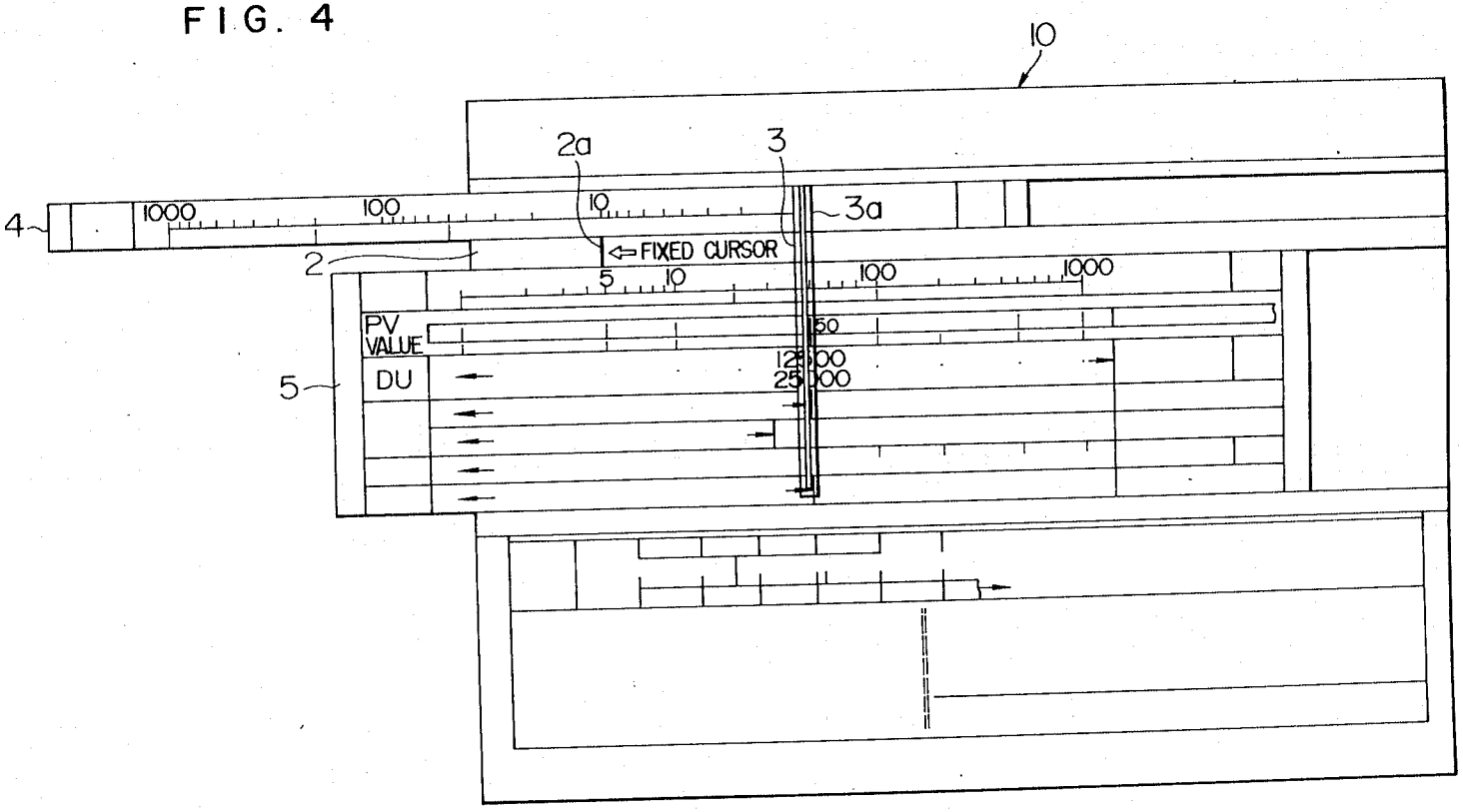

Referring to FIG. 4, the first and second sliding rulers are manipulated in case the sliding speed is 5 cm/sec and the bearing surface pressure is 10 kg/cm$^2$. The PV value thereby found is 50 kg/cm$^2$.cm/sec, and the lifetime of the bearing is found not to be more than two fifths that found in the case shown in FIG. 2. If the bearing material is DU or DX, the bearing lifetime and the bearing working temperature are within safety limits. However, if the bearing material is Daibest with backing metal (DBB) or DEVA, the bearing working temperature and the bearing lifetime are at the upper limit of the safety limits. If the bearing material is Daibest Solid (DBS), the bearing working temperature and the bearing lifetime are beyond safety limits, thereby indicating a dangerous condition. It is therefore necessary to carry out a lifetime test for the bearing.

Figure 5:
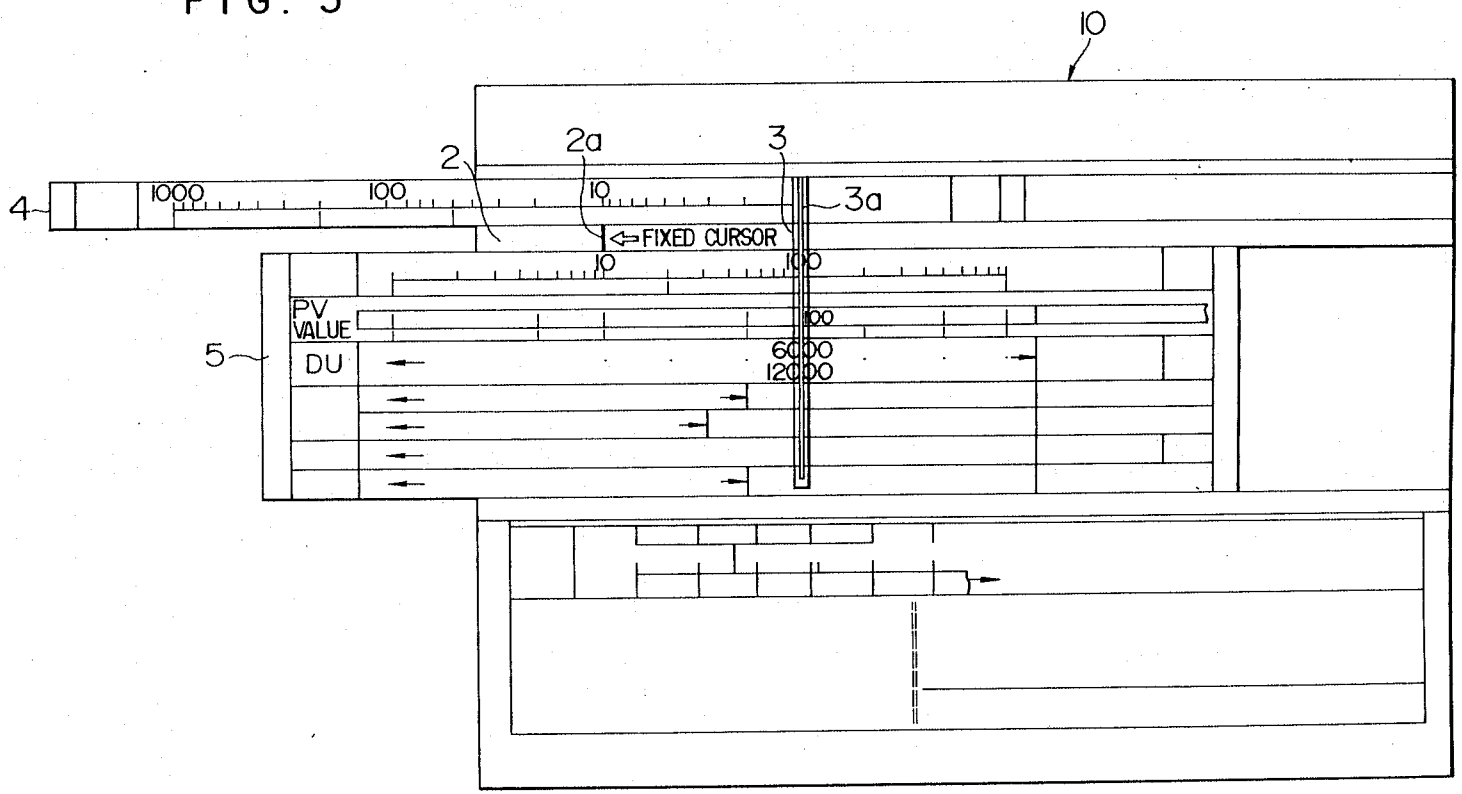

Referring to FIG. 5, the first and second sliding rulers are manipulated in case the sliding speed is 10 cm/sec and the bearing surface pressure is 10 kg/cm$^2$. The PV value thereby found is 100 kg/cm$^2$.cm/sec. When the PV value is above 100 kg/cm$^2$.cm/sec, the bearing lifetime is 6000 hours in the case of a shaft rotation type DU dry bearing, and it is 12,000 hours in the case of the bush rotation type. They are found not to be more than one half that found in the case shown in FIG. 4. If the bearing material is Daibest with backing metal (DBB) or Daibest solid (DBS), the slide rule shows that it is necessary to carry out the lifetime test. If the bearing material is DX, the slide rule shows that it is necessary for the bearing to be greased at intervals. If the bearing material is DEVA metal, the slide rule shows that it is necessary to select a most appropriate DEVA metal different from the standard DEVA metal shown in FIGS. 2 to 4.

Figure 6:
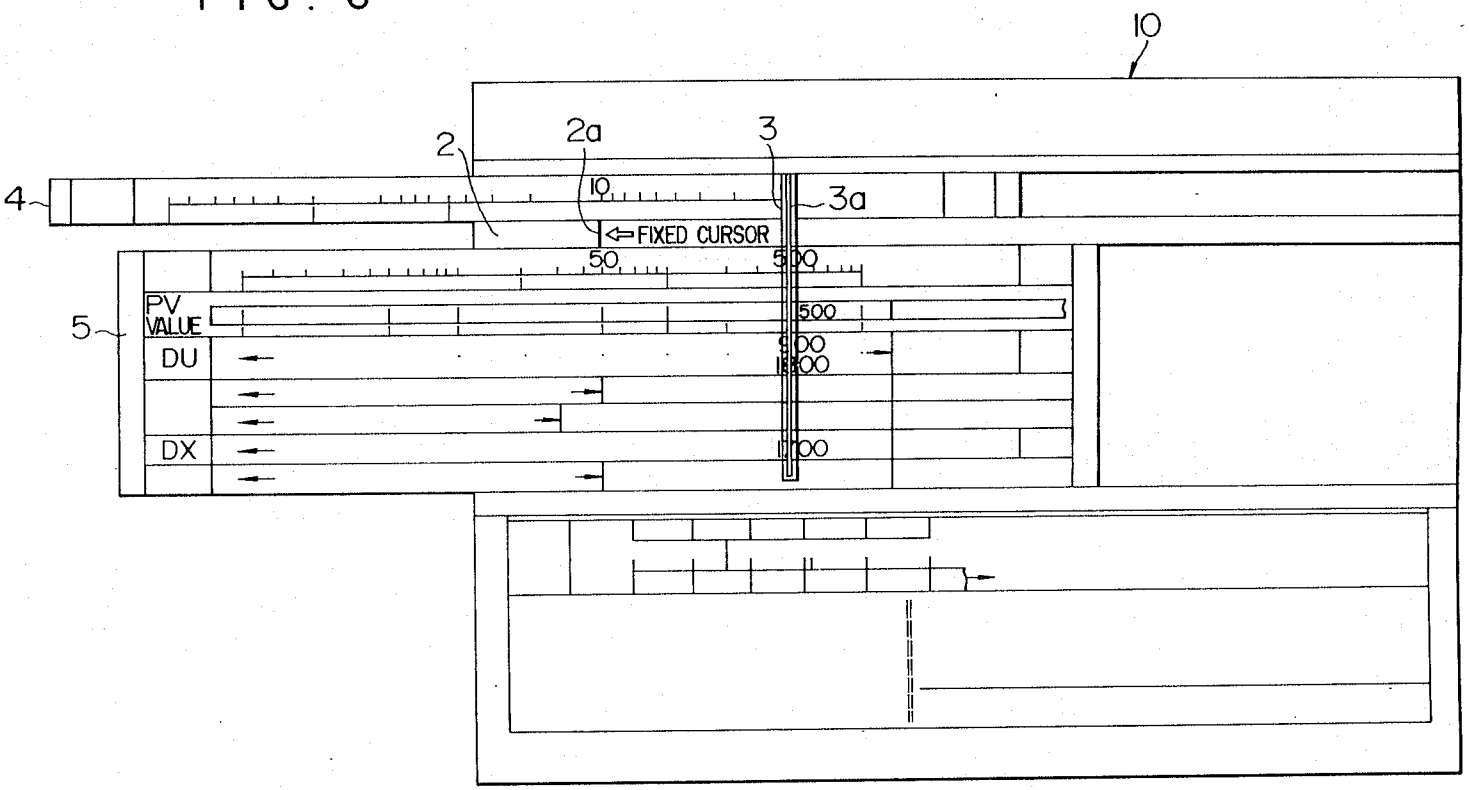

Referring to FIG. 6, it is found that the PV value is 500 kg/cm$^2$.cm/sec in case the sliding speed is 50 cm/sec and the bearing surface pressure is 10 kg/cm$^2$.cm/sec. The lifetime of the DU bearing in the case of the shaft rotation type is 900 hours, which is comparatively short. The slide rule shows that it is necessary to select fluid lubrication such as oil lubrication instead of non-lubrication. The lifetime of the DU bearing in the case of the bush rotation type is 1800 hours, which is considerably short as compared with the values obtained in the cases shown in FIGS. 2 to 5. With respect to Daibest with backing metal (DBB) and Daibest Solid (DBS), the slide rule shows that it is necessary to carry out the lifetime tests. With respect to the DX bearing, the slide rule shows that it is necessary to carry out regreasing at intervals. If the bearing material is DEVA metal, the slide rule shows that the lifetime of the bearing is short and it is necessary to employ fluid lubrication instead of non-lubrication.

Figure 7:
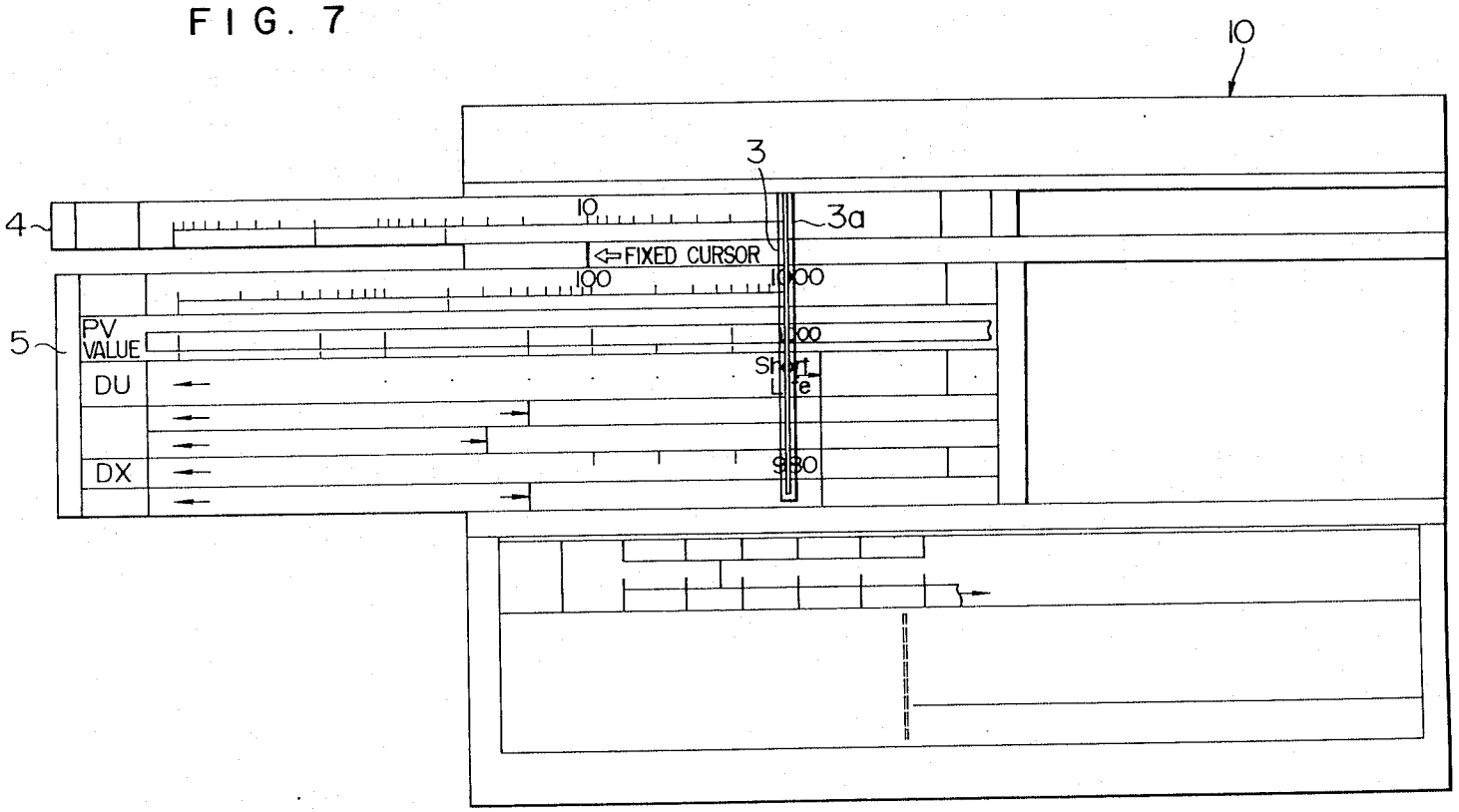

Referring to FIG. 7, it is found that the PV value is 1000 kg/cm$^2$.cm/sec in case the sliding speed is 100 cm/sec and the bearing surface pressure is 10 kg/cm$^2$.cm/sec. The slide rule shows that, under this severe service condition of low load and high sliding speed, the lifetime of each of the DU, Daibest, DX and DEVA dry bearings is short, and that the time interval for regreasing of the DX bearing is 980 hours. It shows that it is not preferable for these dry bearings to be used in oil-free states, and that the bearings require fluid lubrication such as oil lubrication.

Figure 8:
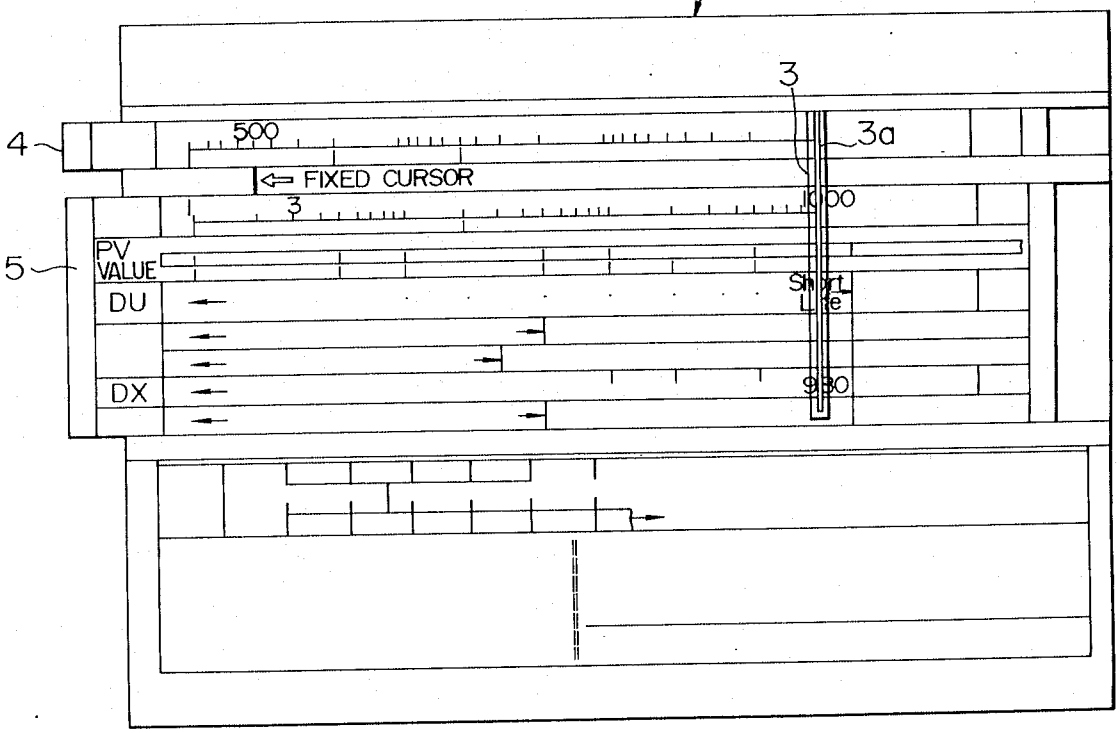

FIG. 8 shows a PV value of 1000 kg/cm$^2$.cm/sec equal to that found in the case shown in FIG. 7, while, in this case, P=500 kg/cm$^2$ and V=2 cm/sec. The slide rule shows that, even under this severe condition of high load and low speed, the lifetime of each of the DU, Daibest, DX and DEVA dry bearings is short, and that the time interval for regreasing of the DX bearing is 980 hours. It also shows that it is necessary for the various bearings to employ fluid lubrication such as oil lubrication instead of non-lubrication.

In the cases shown in FIGS. 3 to 8, the bearing working temperatures are shown as normal temperatures, as in the case shown in FIG. 2. These values may be corrected by multiplying the same by correction factors with respect to the actual temperatures.

In this embodiment, oil-free type DU, Daibest, DX and DEVA dry bearings are selected to exemplify the bearing materials. Other types of dry bearings or various types of fluid-lubricated or oil-lubricated bearings other than dry bearings may also be adopted, with the values of bearing lifetime and logarithmic graduations being inscribed to the slide rule. The slide rule of the present invention for selecting bearing materials is not limited to the above-described materials in the above embodiment and may be applied to other different types of sliding materials.

It is considerably troublesome even for skilled people to select various bearing or sliding materials. There is also a risk of making an error. However, by making use of the slide rule of the invention for selecting bearing materials, even a person who has no expertise can easily find information required in use, such as PV value of a bearing, lifetime of a bearing material, regreasing time, danger limits, attention limits, safety limits and so forth if values of bearing surface pressure and sliding speeds are given. The slide rule of the invention for selecting bearing materials is very useful to salesmen of bearing materials and user designers.

What is claimed is:

1. A slide rule for selecting bearing materials, comprising:

a base plate;

a fixed cursor having first, second and third portions spaced apart from one another and fixedly attached to said base plate, said second portion of said fixed cursor having a fixed cursor line in a vicinity of one end thereof;

a first sliding ruler slidably mounted on said base plate between said first and second portions of the fixed cursor for indicating logarithmic graduations of levels of bearing surface pressure;

an indicator cursor having an indicator cursor line and fixed to the first sliding ruler; and a second sliding ruler slidably mounted on said base plate between said second and third portions of the fixed cursor for indicating logarithmic graduations of sliding speeds, PV values and lifetimes of a plurality of bearing materials, said indicator cursor being operatively connected to said first sliding ruler so that when said first sliding ruler is positioned so that said fixed cursor indicates a particular bearing surface pressure and said second sliding ruler is positioned so that said fixed cursor line indicates predetermined PV values and lifetimes of said plurality of bearing materials.

2. The slide rule according to claim 1, wherein said fixed cursor line is positioned in a vicinity of a left end of the fixed cursor.

3. A slide rule for selecting bearing materials, comprising:

a base plate;

a fixed cursor having first, second and third portions spaced apart from one another and fixedly attached to said base plate, said fixed cursor having a fixed cursor line in vicinity of one end thereof;

a first sliding ruler slidably mounted on said base plate between said first and second portions of the fixed cursor for indicating logarithmic graduations of levels of bearing surface pressure;

an indicator cursor having an indicator cursor line and fixed to the first sliding ruler;

a second sliding ruler slidably mounted on said base plate between said second and third portions of the fixed cursor for indicating logaritmic graduations of sliding speeds, PV values and lifetimes of a plurality of bearing materials; and a fixed ruler mounted on an opposite side of said second sliding ruler than said first sliding ruler with said third portion of said fixed cursor interposed therebetween for indicating bearing temperature and correction factors with respect to bearing temperatures and general information on said plurality of bearing materials, said indicator cursor being operatively connected to said first sliding ruler so that when said first sliding ruler is positioned so that said fixed cursor indicates a particular bearing surface pressure and said second sliding ruler is positioned so that said fixed cursor indicates a particular sliding speed, said indicator cursor line indicates predetermined PV values and lifetimes of said plurality of bearing materials.

4. The slide rule according to claim 2, wherein said fixed cursor line is positioned in a vicinity of a left end of the fixed cursor.

* * * * *